US005769688A

United States Patent [19]

Holliday

[11] Patent Number: 5,769,688

[45] Date of Patent: Jun. 23, 1998

[54] ATHLETIC BREAST AND CHEST PROTECTOR

[76] Inventor: David L. Holliday, 903 Blockade La., Charleston, S.C. 29412

[21] Appl. No.: 617,507

[22] Filed: Mar. 15, 1996

[51] Int. Cl.[6] ..... A41C 3/00; A41D 13/00

[52] U.S. Cl. ..... 450/57; 2/2.5; 2/267; 450/55

[58] Field of Search ..... 2/1, 2, 2.5, 46, 2/267, 268, 73, 48, 49.1–49.5, 50, 51, 52; 450/1, 53, 54, 55, 56, 57, 30, 31, 32, 79, 80, 82

[56] References Cited

U.S. PATENT DOCUMENTS

| | | | |
|---|---|---|---|
| D. 270,489 | 9/1983 | Camus | D2/1 |
| 3,176,686 | 4/1965 | Barnes | 2/2 X |
| 3,478,739 | 11/1969 | Librande | 2/2 X |
| 4,183,097 | 1/1980 | Mellian | 2/2.5 |
| 4,441,211 | 4/1984 | Donzis | 2/2 |
| 4,507,801 | 4/1985 | Kavanagh et al. | 2/2 |
| 4,566,458 | 1/1986 | Weinberg | 450/54 |
| 4,578,821 | 4/1986 | Zufle | 2/2.5 |
| 4,607,640 | 8/1986 | McCusker | 450/1 |
| 5,022,887 | 6/1991 | Lawson | 450/57 X |
| 5,513,393 | 5/1996 | Ferreira et al. | 2/267 |

FOREIGN PATENT DOCUMENTS

| | | | |
|---|---|---|---|
| 2069318 | 8/1981 | United Kingdom | 2/2.5 |

*Primary Examiner*—Jeanette E. Chapman
*Attorney, Agent, or Firm*—Dallis Law Firm, P.A.

[57] ABSTRACT

A breast and chest protector for women athletes designed to protect the breast and upper chest area from impacts caused by bodily contact with other athletes and from balls in play. The breast and chest protector comprises a soft, rubberized foam exterior with a hard, high density plastic internal breast plate. The breast plate is hinged to provide for longitudinal flexing along the sternum between the right and left cups. The breast and chest protector is secured to the chest of a woman by means of adjustable shoulder and back straps that hook around a woman's back. The soft, rubberized foam exterior allows for adequate control of a ball in play as may be required in a sport such as soccer.

4 Claims, 2 Drawing Sheets

ATHLETIC BREAST AND CHEST PROTECTOR

BACKGROUND OF THE INVENTION

1. FIELD OF THE INVENTION

The present invention relates to the field of breast and chest protectors for women and, more particularly, to an athletic breast and chest area protector designed for women who play team sports that involve a high degree of bodily movement and physical contact.

2. DESCRIPTION OF THE RELATED ART

As the field of athletics becomes increasingly more popular among women, both young and older, injuries unique to female athletes garnish greater concern and attention. In particular, women athletes are often not adequately protected from direct impact to the breast or chest area which may result in serious bruising and even long term medical ailments. Different types of athletic activities have different levels of bodily movement and physical contact. Although the sports of soccer, basketball and even baseball are considered non-contact sports, there is still a high degree of potential bodily contact, especially in basketball and soccer when multiple players are rushing to a single ball in play. Impact to the breast and chest area from a flying ball may also cause serious injury to a female athlete. This is particularly true in the games of softball and baseball where the ball is hard and may be traveling at high speeds. In addition to injuries caused by physical contact, injuries may also arise from rigorous bodily movement even from non-contact activities such as aerobics.

Existing breast protectors in this field attempt to incorporate some level of impact protection inside a supportive brassiere. In an attempt to provide an unobtrusive means of protecting a woman's breasts and chest area, however, the prior art fails to provide adequate protection for certain athletic related impacts to the breasts and chest area and fail. U.S. Pat. No. 5,244,432 to May N. Moy Au and Sheryl Unsworth is a good example of the prior art and how such inventions are designed to protect the individual breasts. The Moy Au et al. patent describes an unique brassiere design with a right and left protective cup insert. These protective cups are designed to protect the breast area from athletic and related impacts. The protective cups themselves are designed with a soft foam cushion around the extreme edges of the cups to help absorb impact.

U.S. Pat. No. 4,607,640 to LeRoy H. McCusker is similar to the Moy Au et al. invention in function, in that the main protected area of the female body is the breast area. Also, neither the Moy Au et al. invention nor the McCusker invention protect the center chest or sternum area. The McCusker invention consists of an athletic type brassiere designed with a right and left insert made of a high density polyethylene plastic or similar material. The purpose of the inserts is to provide protective support against impacts during the playing of athletics.

U.S. Pat. No. 5,022,887 to LaJean Lawson is designed similarly to the aforementioned inventions in that there is a right and left protective plate that inserts into a fabric brassiere. These hard cup plates are designed to cover the entire breast and overlap each other near the area of the sternum. According to the inventor, the purpose of the overlap in the sternum area is to provide additional protection to the center chest area. Although the Lawson invention provides protection to the center chest area and sternum, the right and left plates simply overlap, they are not connected at the center in any way.

Unlike the prior art, the present invention incorporates the use of impact absorption material and a high density plastic protective breast plate that comprises a one piece unit with an open center flex point near the sternum area. One primary advantage of such a singular breast plate construction is that any impact to a single breast will be absorbed by and transferred throughout the entire chest area instead of exclusively in the vicinity of the chest area where the breast is located as would be the case with the prior art.

The high density plastic protective breast plate of the present invention is sealed inside a soft, impact absorbing material designed to further soften any impact to the breast and chest area as well as mimic a soft tissue impact of a ball in play when necessary such as in the sport of soccer where the ball may be maneuvered by the chest area.

SUMMARY OF THE INVENTION

It is therefore an objective of this invention to provide adequate protection to women athletes from significant impact to the breast and chest area.

It is further an objective of this invention to provide a breast and chest protector for women athletes that is designed to distribute a localized impact throughout the entire chest region and not exclusively to one side of the chest.

It is still further an objective of this invention to provide a breast and chest protector for women athletes that allows for adequate ball control, especially in the case of soccer, in the chest area by providing a soft cushion outer surface.

It is also an objective of this invention to provide sufficient protection to the sternum area of the chest while still providing adequate flexibility for movement and contortions.

It is yet another objective of this invention to provide adequate support to the breasts during rigorous body movement and motion.

These as well as other objectives are accomplished with an athletic breast and chest protector comprising an internal hard plastic breast plate with a right and left cup joined at the center sternum area by an upper an lower sternum hinge. The hard internal breast plate is encased in an impact absorbing rubberized foam. The thickness of the rubberized foam is greater on the exterior surface of the breast and chest protector than the interior surface in order to maximize direct impact absorption.

The breast and chest protector has a right and left shoulder and back strap that hook around the back and shoulders to secure the protector in place over the breast and chest area. In order to maximize the diffusion of a serious impact to the breast area, the breast and chest protector covers a large area or the chest. The breast and chest protector also helps to hold the breasts in place during rigorous movement such as during aerobic exercises. Both the right and left cups have a right and left bottom lip that extends to the ribs just below the breast.

BRIEF DESCRIPTION OF THE DRAWINGS

A preferred embodiment of the present invention is described herein with reference to the drawings wherein.

DETAILED DESCRIPTION OF THE PREFERRED EMBODIMENT

Figure 1:
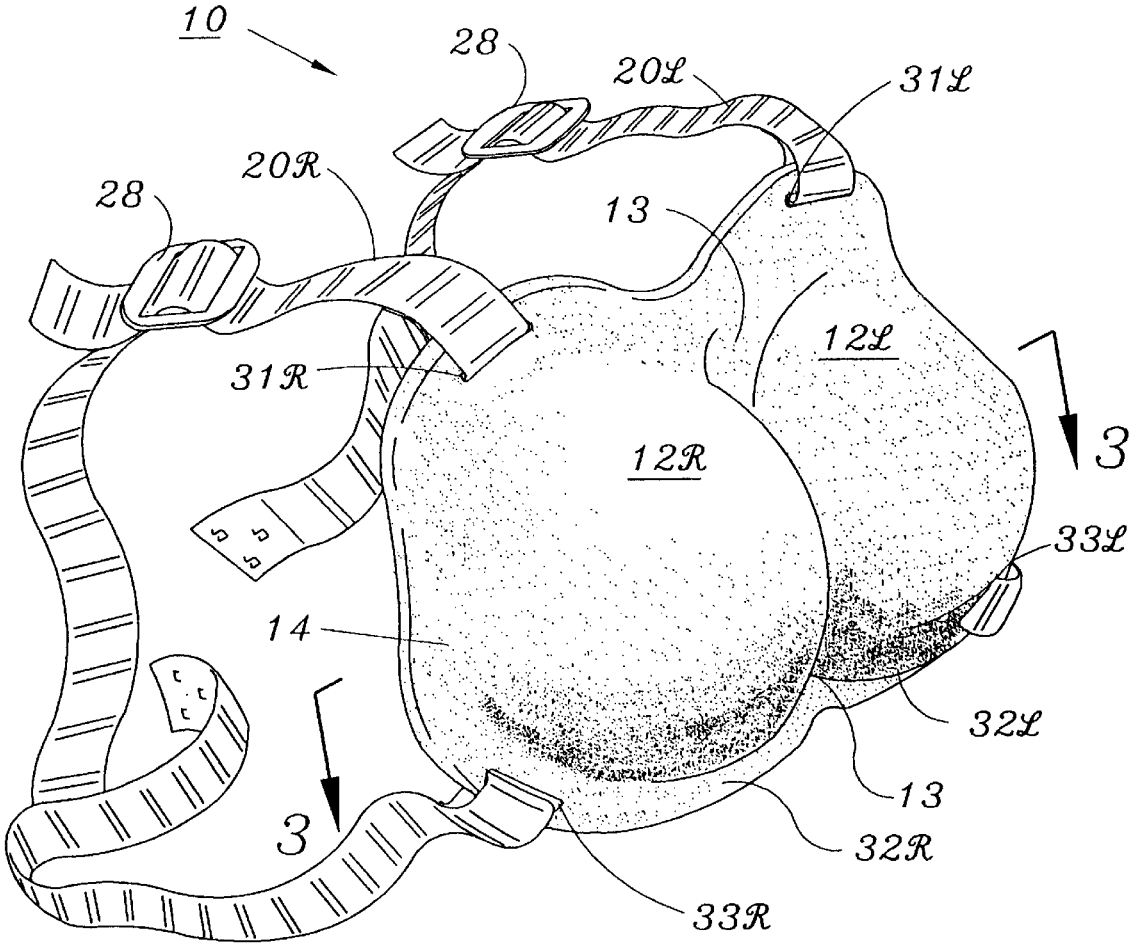
FIG. 1 of the drawings shows a perspective, external view of the present invention revealing the soft rubberized foam exterior and shoulder and back straps.
Figure 2:
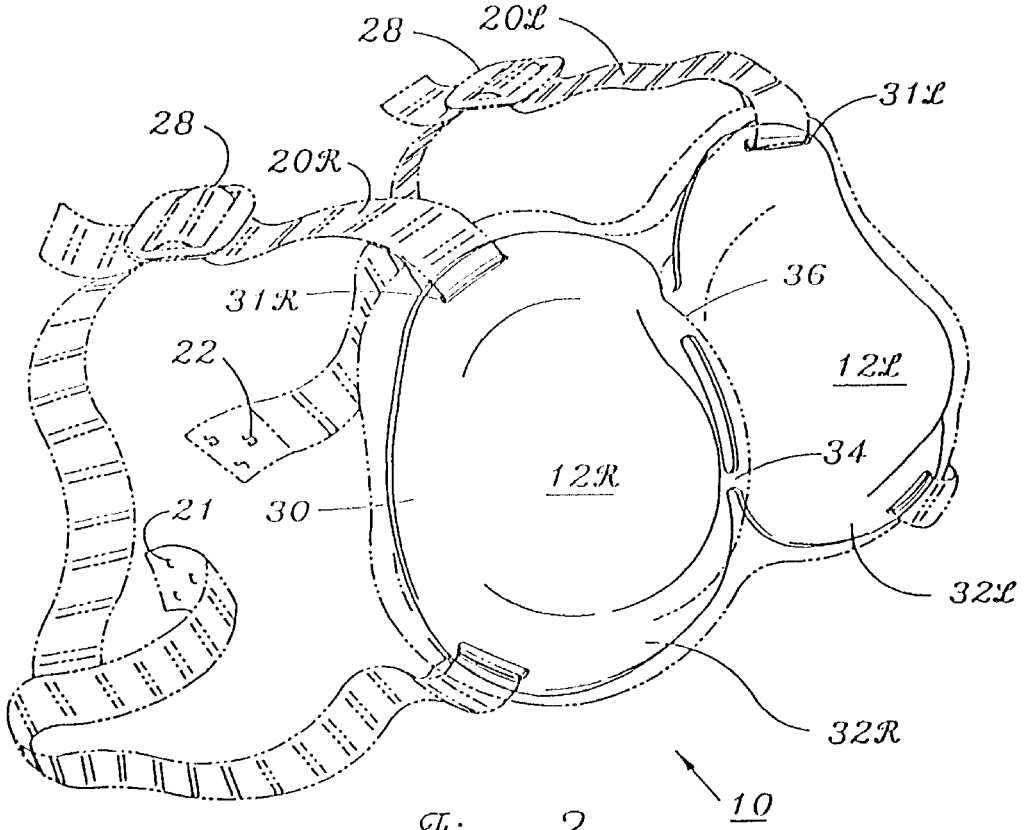
FIG. 2 of the drawings shows a perspective, internal view of the present invention revealing the hard internal breast plate and sternum hinges.
Figure 3:
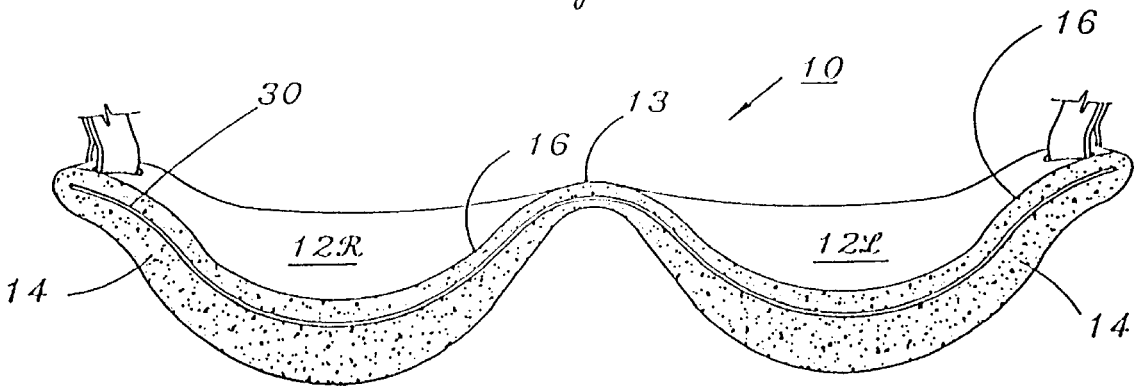
FIG. 3 of the drawings is a cross sectional view of FIG. 2 revealing the difference in thickness of the soft rubberized foam between the inside and outside right and left cups. The internal hard internal breast plate is sandwiched between these two layers or soft rubberized foam.

Referring to the drawings by numerals of reference, there is shown in FIG. 1, 2 and 3 the breast and chest protector (10). The right and left cups (12R and 12L) are shown connected together by the sternum plate (13). The right and left shoulder and back straps (20R and 20L) are secured to the breast and chest protector (10) by hooking to a right and left top slit (31R and 31L) and a right and left side slit (33R and 33L).

Referring to FIG. 1, the soft rubberized foam exterior (14) of the breast and chest protector (10) provides for an initial absorption of any impact to the breast and chest area. This soft rubberized foam exterior (14) is made of a polyethylene plastic material that possesses a soft, almost flesh-like quality. This material will absorb impact from body contact from another player as well as contact from a ball in play. The upper chest and sternum is protected by the center sternum area (13) of the breast and chest protector (10) located between the right and left cups (12R and 12L). In the case of the sport of soccer, a woman athlete can successfully "chest" the soccer ball for proper control. The ribs just below the breasts are provide with added protection by a right and left bottom lip (32R and 32L) just below the right and left cups (12R and 12L).

Still referring to FIG. 1, the strapping means used to secure the chest and breast protector (10) to the chest of a woman athlete is provided by a right and left shoulder and back strap (20R and 20L). The woman's arms pass through the and back straps which are hooked together in the back by corresponding strap hooks (22) and strap loops (21). The right and left shoulder and back straps (20R and 20L) may be tightened or loosened by a buckle adjustment (28).

Referring to FIG. 2, the hard internal breast plate (30) is revealed. This hard internal breast plate (30) helps to displace any impact to the breast and chest protector (10) by spreading the impact over through out the entire hard internal breast plate (30). Unlike the prior art the hard internal breast plate (30) is a singular plate with a lower sternum hinge (34) and upper sternum hinge (36) connecting the right and left cups (12R and 12L). The lower hinge (34) and upper hinge (36) have a shallow slit running lengthwise over the high density plastic material to allow for minor flexing of the right and left cups (12R and 12L). The space between the lower hinge (34) and upper hinge (36) is left open to allow for ventilation yand cooling.

Referring to FIG. 3, a cross sectional view of the breast and chest protector (10) shown in FIG. 1 is provided. The hard internal breast plate (30) is shown sandwiched between a soft rubberized foam interior (16) of the soft rubberized foam and the soft rubberized foam exterior (14). The foam exterior (14) is slightly thicker than the foam interior (16) to act as an initial absorption contact point for an impact. The center sternum area (13) is shown joining the right and left cups (12R and 12L).

A preferred embodiment of the present invention is described herein. It is to be understood, of course, that changes and modifications may be made in the embodiment without departing from the true scope and spirit of the present invention as defined by the appending claims.

That which is claimed is:

1. A chest and breast protector for women athletes, comprising, in combination:

a. a hard internal breast plate formed to provide a right and left cup of equal size, said hard internal breast plate conforming to the contour of a woman's breasts and front torso;

b. a soft rubberized foam exterior and interior surrounding the entirety of said hard internal breast plate;

c. a center sternum area connecting said right and left cups; and d. a sternum hinge member having flexibility along a longitudinal axis passing between said right and left cup.

2. The breast and chest protector as claimed in claim 1 wherein said sternum hinge member of said chest and breast protector comprises an upper and lower sternum hinge providing limited flexing movement along said longitudinal axis.

3. The chest and breast protector as claimed in claim 2 wherein said chest and breast protector further comprises:

a. a right and left bottom lip extending just below the right and left breast providing vertical support to the breasts and protection to the ribs just below the breasts; and b. a strapping means to firmly secure the breasts within said chest and breast protector against the chest area of a woman whereby the breasts and surrounding connective tissues are protected from adverse effects of acceleration and deceleration movements.

4. The chest and breast protector as claimed in claim 3 wherein said soft rubberized foam exterior has a slightly greater thickness than that of said interior soft rubberized foam interior for absorbing direct impact upon said soft rubberized foam exterior of said chest and breast protector such that contact by a ball in play may mimic normal body contact.

* * * * *